US005928087A

United States Patent [19]

Emberton et al.

[11] Patent Number: 5,928,087

[45] Date of Patent: Jul. 27, 1999

[54] ADJUSTABLE LOFT GOLF CLUB

[75] Inventors: Elaine Simone Emberton; George Thomas Harvey, both of Nanaimo, Canada; Thomas Ramsay Watson, 14 - 2501 Labieux Street, Nanaimo, British Columbia, Canada, V9T 5A6

[73] Assignee: Thomas Ramsay Watson, Nanaimo, Canada

[21] Appl. No.: 08/906,272

[22] Filed: Aug. 5, 1997

[51] Int. Cl.[6] ..... A63B 53/08

[52] U.S. Cl. ..... 473/245; 403/97

[58] Field of Search ..... 473/288, 245, 473/246, 247; 403/97

[56] References Cited

U.S. PATENT DOCUMENTS

| | | | |
|---|---|---|---|
| 569,438 | 10/1896 | Urquhart . | |
| 1,137,457 | 4/1915 | Breitenbaugh . | |
| 1,594,350 | 8/1926 | Perkins . | |
| 1,769,235 | 7/1930 | Samaras et al. . | |
| 1,983,196 | 12/1934 | Spiker | 273/77 |
| 2,329,313 | 9/1943 | Winter | 273/79 |
| 2,477,438 | 7/1949 | Brouwer . | |
| 2,882,053 | 4/1959 | Lorthiois | 473/245 |
| 5,083,779 | 1/1992 | Ungermann | 273/79 |
| 5,133,553 | 7/1992 | Divnick . | |
| 5,353,346 | 1/1995 | Carroll et al. | 273/79 |

FOREIGN PATENT DOCUMENTS

| | | | |
|---|---|---|---|
| 03267079 | 11/1991 | Japan | A63B 53/06 |
| 599655 | 3/1948 | United Kingdom | 273/79 |
| WO 88/07880 | 10/1988 | WIPO | A63B 53/06 |

*Primary Examiner*—Sebastiano Passaniti
*Attorney, Agent, or Firm*—Chernoff, Vilhauer, McClung & Stenzel

[57] ABSTRACT

A golf club having a blade which is securable to the shaft of the club at a plurality of different angular positions to vary the loft of the striking face of the blade. The invention is a substitute for an entire set of iron golf clubs, including a putter. The club shaft has a frustoconical spline at a lower end thereof having a plurality of teeth which taper inwardly. The spline is received in a mating socket formed at the tail end of the blade when the blade and shaft are releasably coupled together.

7 Claims, 2 Drawing Sheets

ADJUSTABLE LOFT GOLF CLUB

TECHNICAL FIELD

This application relates to a golf club having a blade which is securable to the shaft of the club at a plurality of different angular positions to vary the loft of the striking face of the blade. The invention is a substitute for an entire set of iron golf clubs, including a putter.

BACKGROUND

Golfers typically carry a set of clubs of different lofts for maximum shot selection. For example, it is commonplace to carry several "low iron" clubs to impart a low trajectory to a golf ball for maximum distance as well as several "high iron" clubs or pitching wedges to impart a very high trajectory to the golf ball to escape sand traps or avoid other hazards close to the putting green. However, a full set of golf clubs is relatively heavy to carry, especially for very young or elderly golfers playing without the benefit of a caddy or golf cart. A full set of clubs is also bulky which makes storage and travel on golfing vacations more inconvenient.

One solution to the above problems is to provide a single golf club having a striking face which may be selectively inclined at different angles to vary the loft of the club. Golf clubs having adjustable lofts have been described in the prior art for more than one hundred years. For example, U.S. Pat. No. 569,438, which issued to Urquhart on Oct. 13, 1896, relates to a golf club head which is securable to a separate shaft at a variety of different angles. In particular, the tailpiece of the head has a series of teeth or splines around its circumference which are designed to mate with corresponding grooves or teeth formed in a recess of the shaft.

U.S. Pat. Nos. 1,137,457, 1,769,235, 2,477,438 and 5,133,553 similarly disclose various golf club designs wherein the loft of the striking face may be adjusted. However, none of these designs have enjoyed widespread market acceptance. Some of the designs employ an elaborate assembly of separate parts to couple the blade to the main shaft of the club which increases the cost of manufacture and reduces long-term reliability. Another drawback of some prior art designs is that the club cannot be quickly and securely adjusted between different settings during the course of a round of golf.

The need has therefore arisen for an adjustable loft golf club of simple design for reliably securing a blade at a selected angular position relative to a shaft and which may be quickly adjusted between shots.

SUMMARY OF THE INVENTION

In accordance with the invention, an adjustable loft golf club is provided. The club includes a shaft having a bevelled spline a lower end thereof, the spline having a plurality of circumferentially spaced first teeth which taper inwardly. The club also includes a blade separate from the shaft and having a recessed socket at one end thereof for matingly receiving the bevelled spline, the socket having a plurality of circumferentially spaced second teeth which taper outwardly. Fastening means are provided for releasably coupling the blade and the shaft together such that the first teeth lockably inter-engage with the second teeth to maintain the blade at a selected angular position relative to the shaft. The blade may be adjusted to different angular positions relative to the shaft to vary the loft of the striking face of the golf club.

Preferably the spline is frustoconical in shape such that first teeth taper outwardly at an angle of approximately 45°. The club may include indicia on the shaft lower end which is alignable with a reference marking on an outer surface of the socket to enable quick adjustment of the golf club to the desired angular position.

The fastening means preferably comprises a bolt which projects from a central portion of the socket and is insertable through an aperture formed in a lower portion of the shaft; and a nut for releasably engaging a free end of the bolt.

BRIEF DESCRIPTION OF DRAWINGS

In drawings which illustrate the preferred embodiment of the invention, but which should not be construed as restricting the spirit or scope of the invention in any way.

DETAILED DESCRIPTION OF THE PREFERRED EMBODIMENT

Figure 4:
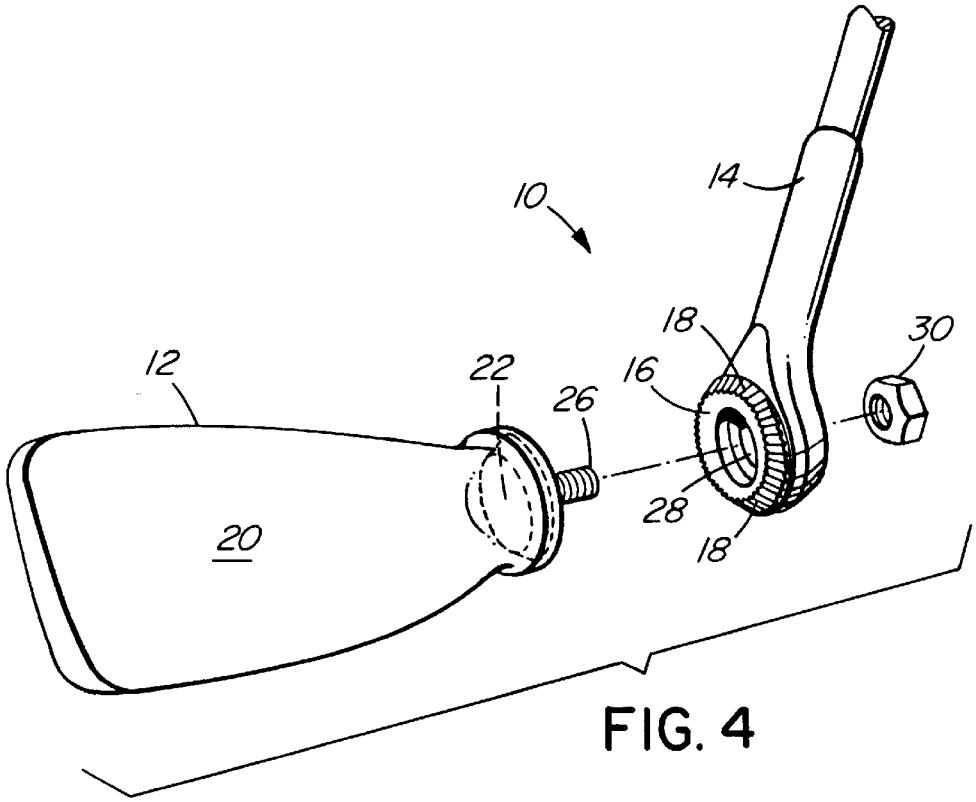
FIG. 4 is an exploded view of a lower portion of the applicant's golf club showing the means for coupling the blade to a lower portion of the shaft.

This application relates to a golf club 10 which comprises a blade 12 and a separate shaft 14. Blade 12 may be releasably coupled to shaft 14 at a selected angular position to adjust the loft of club 10. As best shown in FIG. 4, shaft 14 has a bevelled, annular spline 16 at its lower end comprising a plurality of circumferentially spaced first teeth 18. Spline 16 is generally frustoconical in shape such that first teeth 18 taper inwardly at an angle of approximately 45°. Spline 16 preferably comprises approximately eighty first teeth 18 (i.e. the angle between adjacent teeth is approximately 4.5°).

Figure 5:
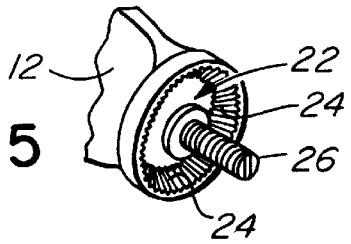
FIG. 5 is an enlarged, fragmented view of the socket provided at one end of the golf club blade.

Blade 12 has a striking face 20 and a recessed socket 22 at a tail end thereof. Socket 22 is sized and shaped to matingly receive spline 16 and includes a plurality of circumferentially spaced second teeth 24 as shown best in FIG. 5. Second teeth 24 preferably taper outwardly at an angle of approximately 45° to match the taper of first teeth 18.

Figure 7:
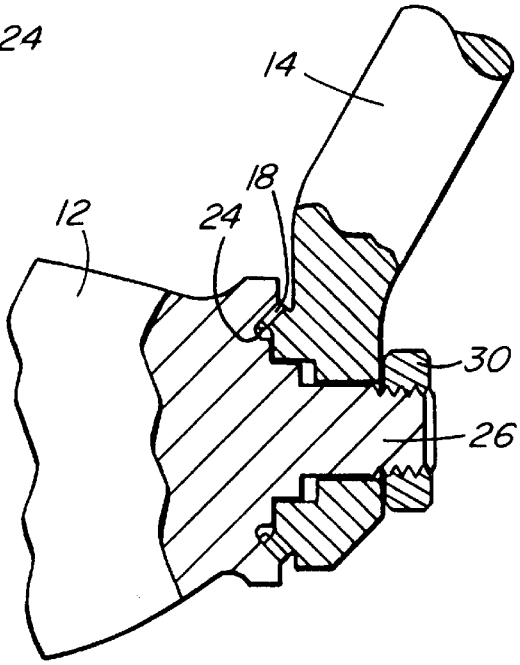
FIG. 7 is an enlarged, cross-sectional view of the lower portion of the applicant's golf club showing the means for coupling the blade to the shaft.

Golf club 10 further includes "fastening means" for releasably coupling blade 12 to shaft 14 at a selected angular position. The fastening means may comprise an elongated bolt 26 which projects from a central portion of socket 22 and is insertable through an aperture 28 formed in the lower end of shaft 14 (FIG. 4). A nut 30 is provided for threadedly engaging the free end of bolt 26 to adjustably couple blade 12 to shaft 14. As shown best in FIG. 7, when blade 12 and shaft 14 are tightly coupled together, teeth 18 and 24 inter-engage to prevent deflection of blade 12 relative to shaft 14 when a golf ball is struck.

Figure 1:
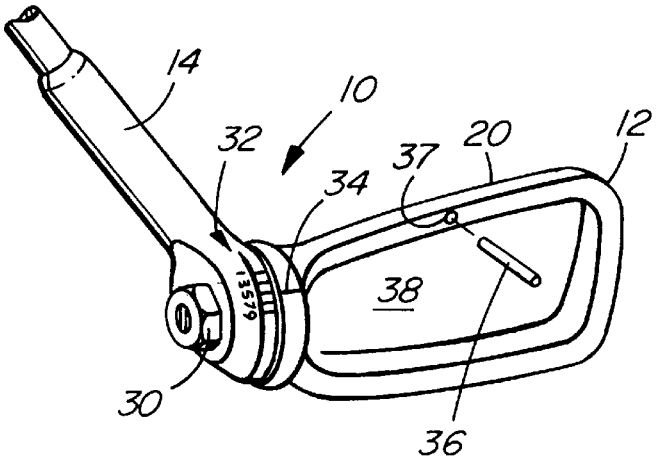
FIG. 1 is a rear isometric view of the lower portion of the applicant's golf club showing the blade coupled at a selected angular position to the shaft.
Figure 2:
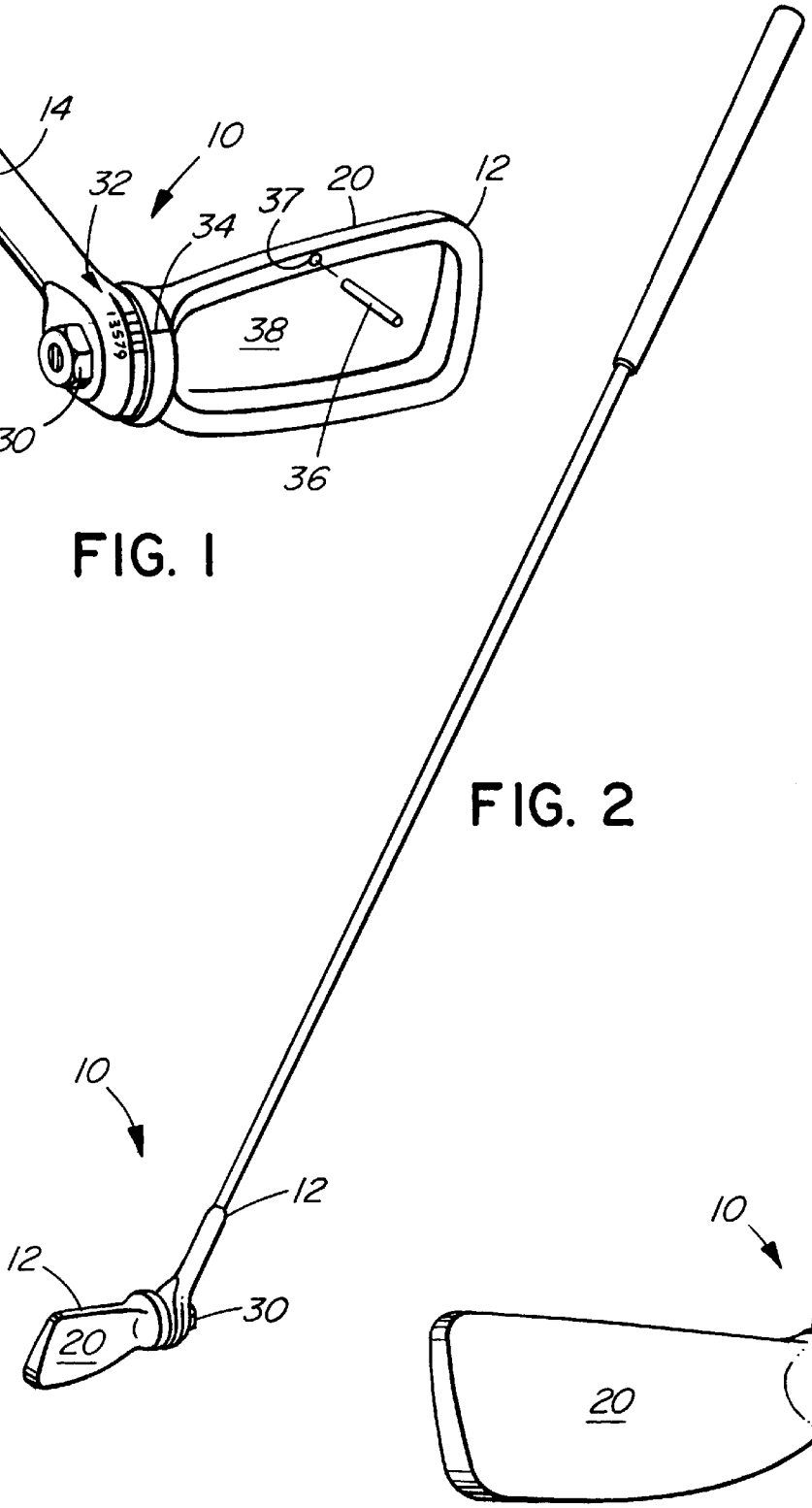
FIG. 2 is a front isometric view of the applicant's golf club.
Figure 3:
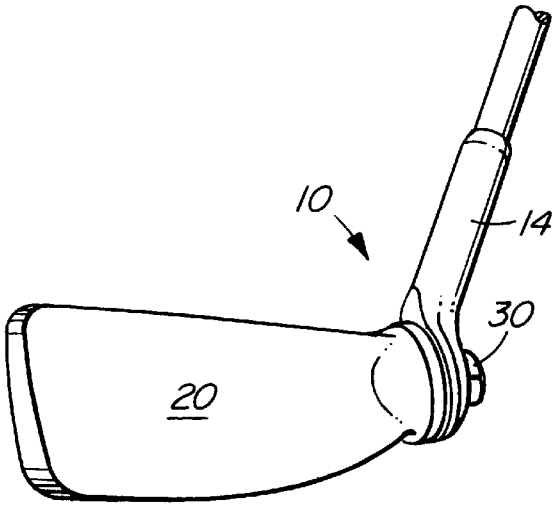
FIG. 3 is a front isometric view of a lower portion of the golf club of FIGS. 1 and 2.
Figure 6:
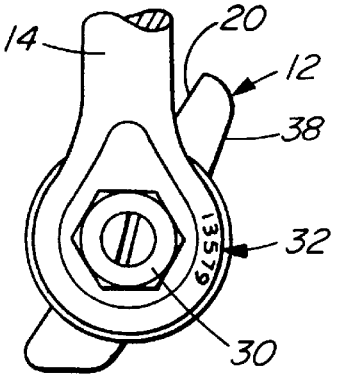
FIG. 6 is a rear isometric view of the golf club of FIG. 1.

As shown best in FIGS. 1 and 6, shaft 14 preferably includes indicia 32 at its lower end comprising a series of spaced markings which are selectably alignable with a reference marking 34 on the outer surface of socket 22. Indicia 32 represent different iron settings. For example, in FIG. 1, the setting corresponding to numeral 5 is aligned with reference marking 34. This means that the loft of striking face 20 is set at approximately 27° relative to a vertical axis which corresponds to the loft of a conventional 5-iron club. If, for example, club 10 is adjusted so that the setting corresponding to numeral 3 is aligned with reference marking 34, then a loft of striking face 20 would be reduced to approximately 18°, corresponding to the loft of a conventional 3-iron club.

In the illustrated embodiment, only odd number settings are shown. However, settings corresponding to even numbered irons may be achieved by aligning reference marking 34 half-way between respective odd number settings. For example, if marking 34 is aligned part-way between numerals 3 and 5, this would correspond to the loft of a conventional 4-iron, namely approximately 22.5°.

As should be apparent to someone, skilled in the art, striking face 20 could be adjusted to a fully vertical orientation to use club 10 for the purpose of putting. In one embodiment of the invention, an alignment pin 36 could be releasably secured to a rear surface 38 of blade 12. Pin 36 extends perpendicular to the plane of striking face 20 to assist the user in aligning putts.

An important feature of club 10 is its ease of adjustability. Since inter-engaging teeth 18, 24 are tapered, they may be disengaged from one another by loosening nut 30 one full turn using a small wrench or any other suitable tool. Bolt 26 is preferably coarse threaded so that approximately a full turn of the nut would loosen the nut approximately one sixteenth of an inch. Thus, it is possible to quickly adjust the loft of club 10 between different settings as discussed above by only slightly loosening nut 30. However, when nut 30 is re-tightened, teeth 18, 24 will securely inter-engage to prevent deflection of the club blade 12 during use. This is a significant advantage over prior art adjustable clubs employing inter-engaging teeth where more effort is required on the part of the user in order to effect adjustments.

In an alternative embodiment of the invention, the handle portion of shaft 14 could be telescopic to enable the user to adjust the length of shaft 14. In another embodiment, nut 30 could be replaced with a wing nut which could be loosened or tightened by hand. In still another embodiment, the lower end of shaft 14 could include a recess for receiving nut 30 when blade 12 and shaft 14 are coupled together. As should be apparent to someone skilled in the art, other equivalent means for releasably coupling blade 12 and shaft 14 may also be envisioned.

As will be apparent to those skilled in the art in the light of the foregoing disclosure, many alterations and modifications are possible in the practice of this invention without departing from the spirit or scope thereof Accordingly, the scope of the invention is to be construed in accordance with the substance defined by the following claims.

What is claimed is:

1. An adjustable loft golf club comprising:

(a) a shaft having a frustoconical-shaped spline at a lower end thereof, said spline having a first central axis and comprising a plurality of circumferentially spaced first teeth which taper inwardly toward said first central axis;

(b) a blade having a recessed socket at a heel end thereof for matingly receiving said spline, wherein said socket comprises a second central axis and a plurality of circumferentially spaced second teeth which taper outwardly in a direction away from said second central axis; and (c) fastening means for releasably coupling said blade and said shaft together when said first and second central axes are aligned such that said first teeth lockably inter-engage with said second teeth to maintain said blade at a selected angular position relative to said shaft.

2. The golf club as defined in claim 1, wherein said first teeth taper inwardly at an angle of approximately 45° relative to said first central axis.

3. The golf club as defined in claim 2, further comprising indicia on an outer surface of said shaft lower end which is alignable with a marking on an outer surface of said socket to enable adjustment of said golf club to said selected angular position.

4. The golf club as defined in claim 2, wherein said spline is annular and wherein said fastening means comprises:

(a) an elongated member projecting from said socket and insertable through an aperture formed in a lower portion of said shaft; and (b) a fastener for releasably engaging a free end of said elongated member.

5. A golf club as defined in claim 4, wherein said elongated member comprises an externally threaded bolt and wherein said fastener comprises an internally threaded nut.

6. A golf club as defined in claim 1, wherein said spline comprises approximately 80 of said first teeth.

7. An adjustable loft golf club comprising:

(a) a shaft;

(b) a blade; and (c) a fastener for releasably coupling said shaft and said blade together, wherein one of said shaft and said blade comprises a frustoconical-shaped spline, said spline having a first central axis and a plurality of circumferentially spaced first teeth which taper inwardly toward said first central axis, and the other of said shaft and said blade comprises a socket for matingly receiving said spline, said socket comprising a second central axis and a plurality of circumferentially spaced second teeth which taper outwardly in a direction away from said second central axis, wherein said first teeth lockably inter-engage with said second teeth when said fastener is secured to maintain said blade at a selected angular position relative to said shaft.

* * * * *